United States Patent [19]

Vendramini

[11] Patent Number: 4,800,796

[45] Date of Patent: Jan. 31, 1989

[54] METHOD OF MANUFACTURING STRUCTURAL MEMBERS BY BRAIDING THREADS, AND STRUCTURAL MEMBERS OBTAINED THEREBY

[76] Inventor: Dante Vendramini, 34, rue du Général Leclerc, 92270 Bois Colombes, France

[21] Appl. No.: 21,773

[22] Filed: Mar. 4, 1987

Related U.S. Application Data

[60] Continuation-in-part of Ser. No. 912,638, Sep. 26, 1986, abandoned, which is a division of Ser. No. 713,667, Mar. 19, 1985, Pat. No. 4,614,147.

[30] Foreign Application Priority Data

May 22, 1984 [FR] France ..... 84 04478

[51] Int. Cl.[4] ..... D04C 1/06; D04C 3/00; D04C 3/02

[52] U.S. Cl. ..... 87/5; 87/6; 87/7; 87/8; 87/11; 87/28; 87/30; 87/33; 87/34

[58] Field of Search ..... 87/1, 5–8, 87/11, 28–30, 33, 34; 57/3, 6, 10–12, 210; 156/148, 149, 393; 428/116, 224, 225

[56] References Cited

U.S. PATENT DOCUMENTS

| | | | |
|---|---|---|---|
| 2,936,670 | 5/1960 | Walter | 87/8 |
| 2,949,807 | 8/1960 | Herzog et al. | 87/8 |
| 3,323,406 | 6/1967 | Mitchell | 87/7 |
| 3,338,129 | 8/1967 | Mitchell et al. | 87/7 |
| 3,344,699 | 10/1967 | Ohno | 57/210 X |
| 3,405,598 | 10/1968 | Iwai | 87/7 |
| 3,426,804 | 2/1969 | Bluck | 87/33 X |
| 3,870,580 | 3/1975 | Belcher | 156/181 |
| 3,955,467 | 5/1976 | Johnson, Jr. | 57/210 X |
| 4,137,354 | 1/1979 | Mayes, Jr. et al. | 428/116 |
| 4,312,261 | 1/1982 | Florentine | 87/33 |
| 4,426,908 | 1/1984 | Ullmann | 87/11 X |
| 4,614,147 | 9/1986 | Vendramini | 87/6 X |
| 4,621,560 | 11/1986 | Brown et al. | 87/8 |

*Primary Examiner*—John Petrakes

*Attorney, Agent, or Firm*—Kane, Dalsimer, Sullivan, Kurucz, Levy, Eisele and Richard

[57] ABSTRACT

A method of manufacturing an elongated braided structural member having high mechanical strength, including the steps of providing at least three primary elongated cores, parallel and spaced from one another, and helically winding a plurality of threads around said cores, at least two threads being wound around any pair of primary cores.

32 Claims, 18 Drawing Sheets

FIG. 23
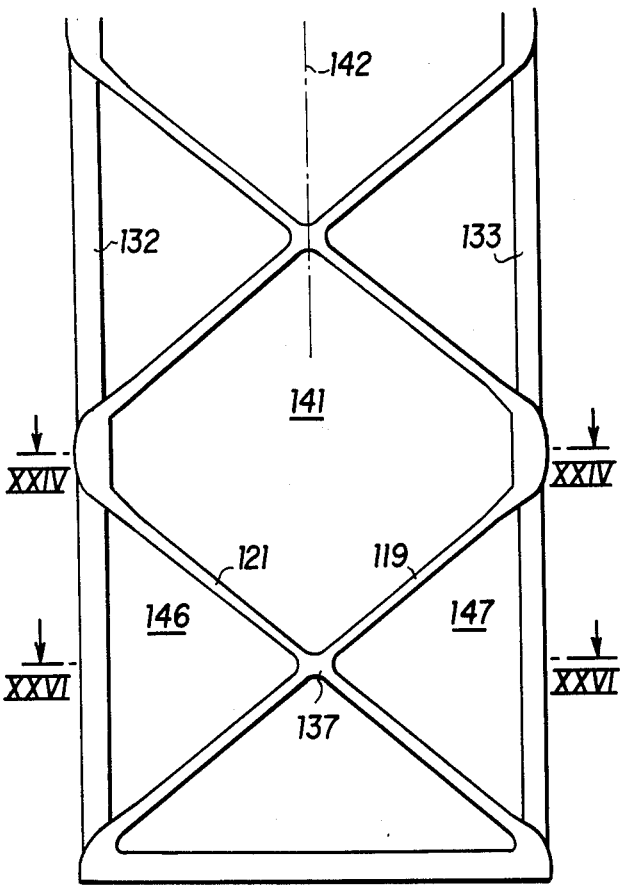
FIG. 25
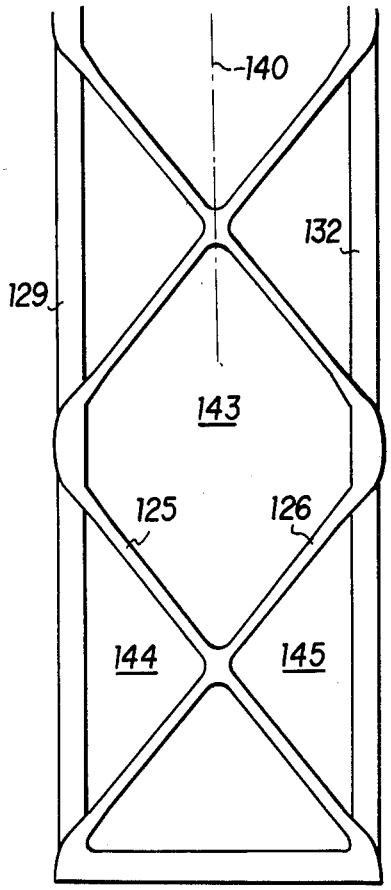
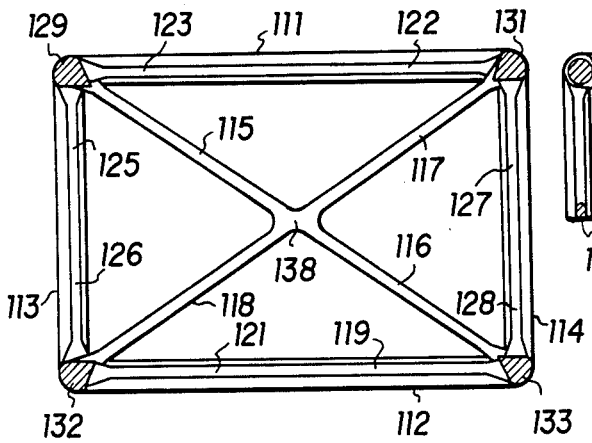
FIG. 24
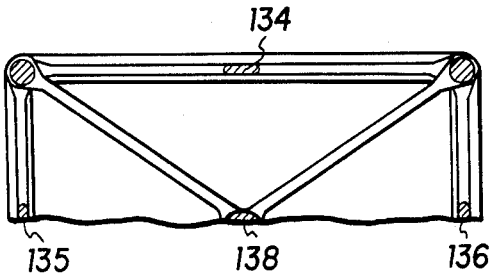
FIG. 26

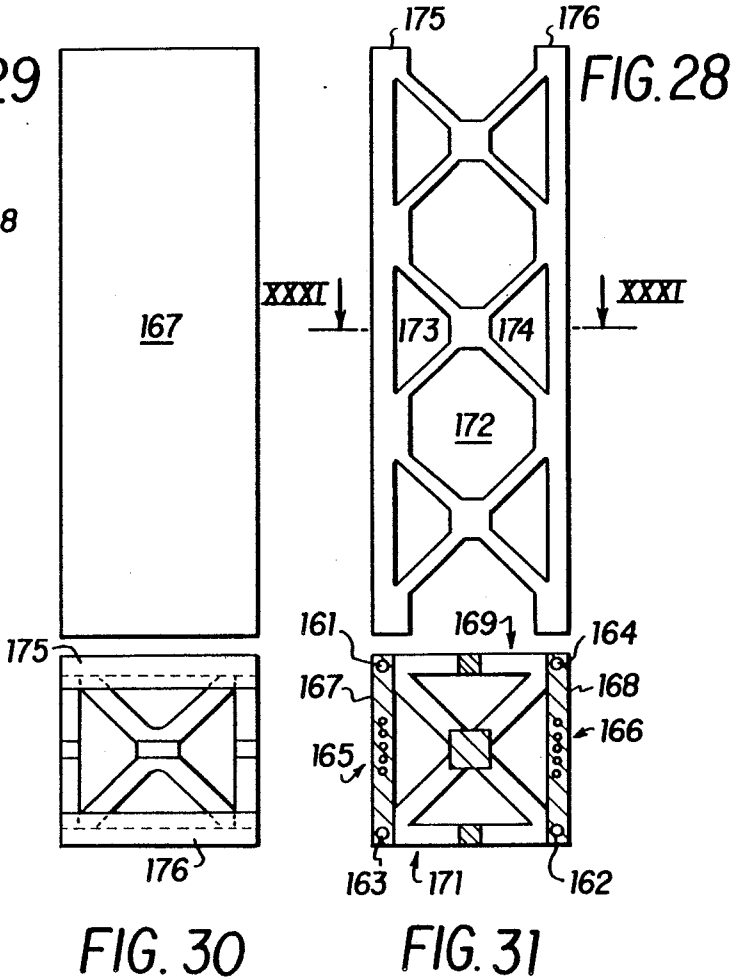
FIG. 28
FIG. 29
FIG. 31
FIG. 30
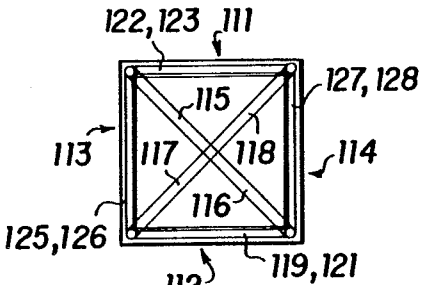
FIG. 27
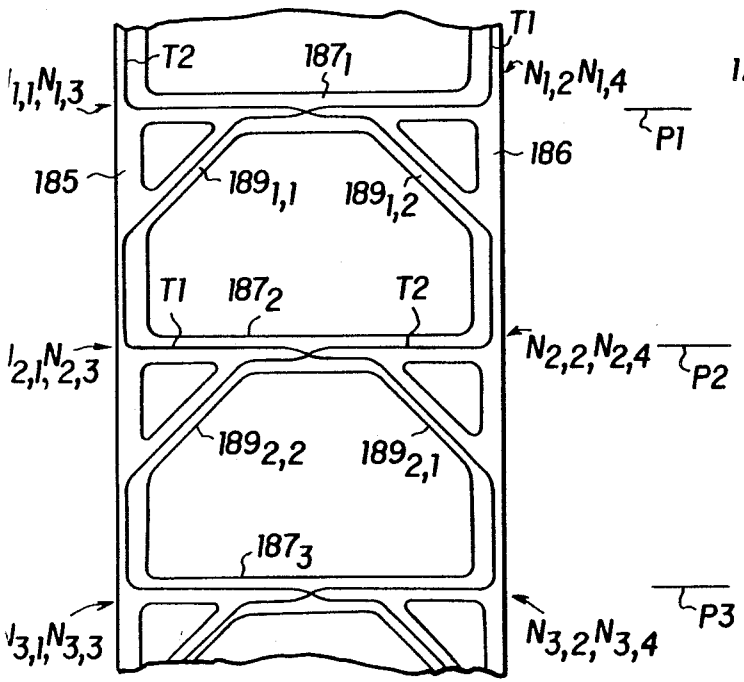
FIG. 45

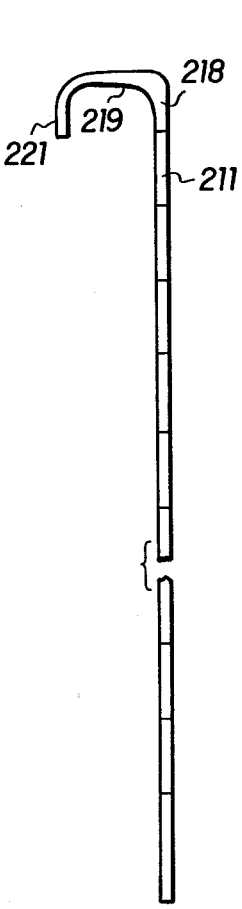
FIG. 38
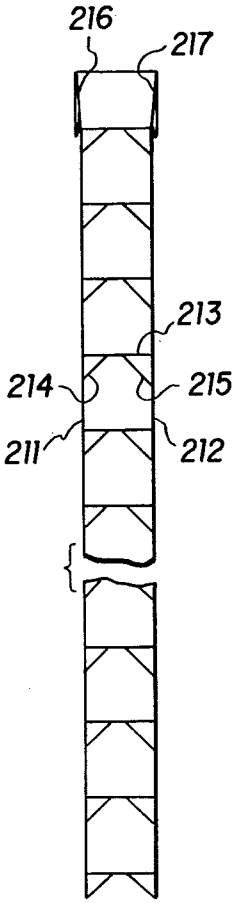
FIG. 37
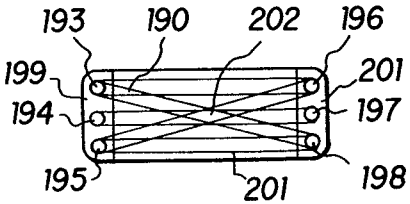
FIG. 36
FIG. 34
FIG. 32
FIG. 35
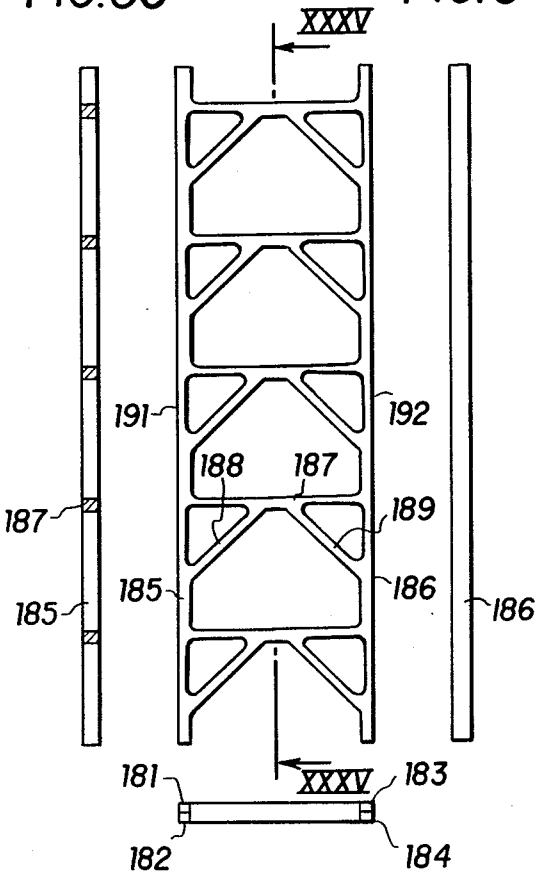
FIG. 33

METHOD OF MANUFACTURING STRUCTURAL MEMBERS BY BRAIDING THREADS, AND STRUCTURAL MEMBERS OBTAINED THEREBY

This is a continuation-in-part of copending application Ser. No. 912,638 filed on Sept. 26, 1986, now abandoned, which was a divisional application of application Ser. No. 713,667 filed Mar. 19, 1985 now U.S. Pat. No. 4,614,147 issued Sept. 30, 1986.

The present invention relates to a method of manufacturing structural members by braiding threads and also to structural members obtained by using the method.

BACKGROUND OF THE INVENTION

Generally speaking, it is desirable for structural members to have maximum mechanical strength and minimum weight, and this is equally applicable to small and to large structures.

To this end, proposals have been made to make such members from threads of various materials which are assembled by being interwoven and which are often embedded in a hardened resin.

The object of the invention is to provide a method capable of assembling thread-like elements in configurations that give rise to members having high mechanical strength and capable of taking full advantage of the intrinsic qualities of fibers which have recently become available such as carbon fibers, "kevlar" fibers, glass fibers, etc.

The object of the invention is more particularly to provide a method capable of covering elongate elements or cores (which may be thread-like or strip-like and made of glass fibers, carbon fibers or analogous fibers) with helically-wound threads, e.g. made of glass fibers, and with the dispositions of the cores and of the windings being chosen at will as a function of the desired structural characteristics, thereby providing industry with members better able than before to satisfy conditions of mechanical strength, of lightness, and of compactness as desired in many applications.

In machines for braiding or stranding, the threads are drawn from a plurality of spools which are rotatably mounted about their axes, and which up to now have been fixed in position relative to one another.

SUMMARY OF THE INVENTION

The invention in one aspect provides a method wherein the spools or shuttles from which are drawn the threads intended to constitute the structural member core coverings, are displaceable in a plane transversal to the traction direction, with displacements being controlled to provide the desired thread configuration around the cores.

A machine for implementing the method of the invention includes at least one spool which is displaceable in a plane transversal to the traction direction of its thread, initially in parallel to a plane corresponding to a core or cores to be covered, as shown by two threadlike elements or by a strip-like element, and then transversely to the said plane and again parallel thereto, but in the opposite direction to the first movement, etc.

It is then possible to make a multiplicity of coverings for the core, either simultaneously or otherwise, which are parallel and/or transversal to one another, thereby providing a structural member having the desired mechanical characteristics.

The machine thus builds up a structural member in a succession of work periods, each of which comprises making the various covering over a predetermined length or pitch.

Such stepwise manufacturing favors automation of the various steps and thus favors minimal cost prices, and elements of uniform quality.

Coverings may be made in helical windings by combining a traction exerted on a thread with a movement of the spool from which the thread comes in a plane perpendicular to the traction direction.

However, in this respect the invention also provides for a first step during which the thread is taken from the spool without the spool moving bodily in a plane perpendicular to the traction, with movement taking place in this plane during a second step. To this end, the spool may be rotatably mounted about its axis by means of resilient return means.

The invention also provides for using the openings which occur naturally from the oblique disposition of the helically wound strands of thread to insert shaping means that stabilize the open work configuration of the structural member.

Also in accordance with the invention, the shaping means are applied to facilitate the process of longitudinally driving the member during manufacture.

When the structural member is to include a resin, the resin may be put into place prior to and/or during the core-covering stage of structural member manufacture, and/or after said covering stage.

In particular, the cores and/or the threads can be embedded in the resin, the latter being then molded for shaping the member.

The invention provides structural members obtained by means of the method, regardless of whether the members are large like beams, or relatively small like the frames of tennis rackets.

In the braiding method and the structural member, a plurality of threads are wound around at least three primary elongated cores which are parallel and spaced from one another, at least two threads being wound around any pair of primary cores.

In particular, four primary cores and twenty-four threads can be provided, four threads being wound around each of the six pairs formed by the four cores, and two of said four threads being wound in one winding directions and the two others in the opposite winding direction.

Preferably, the four cores are disposed, at viewed in transverse section, at the apexes of a convex quadrilateral, particularly a rectangle.

BRIEF DESCRIPTION OF THE DRAWINGS

Embodiments of the invention are described by way of example with reference to the accompanying drawings, in which:

FIG. 23 is a part view in elevation of a frame member in accordance with the invention;

FIG. 24 is a section on a line XXIV—XXIV of FIG. 23;

FIG. 25 is a similar view to FIG. 23, but at 90° thereto;

FIG. 26 is a half view in section on the line XXVI—XXVI of FIG. 23;

FIG. 27 is a similar view to FIG. 24, but showing a variant;

FIG. 28 is a similar view to FIG. 23, but showing another form of frame member;

FIG. 29 is a similar view to FIG. 28, but at 90° thereto;

FIG. 30 is a plan view seen from above and corresponding to FIG. 29;

FIG. 31 is a section on a line XXXI—XXXI of FIG. 28;

FIG. 32 is a front view of a frame member, for another embodiment;

FIG. 33 is a corresponding end view;

FIG. 34 is an elevation view of the same member, but at 90° to FIG. 32;

FIG. 35 is a section on a line XXXV—XXXV of FIG. 32;

FIG. 36 is a similar view to FIG. 33, but showing a variant;

FIG. 37 is a front view of another frame member in accordance with the invention;

FIG. 38 is a corresponding side view;

FIG. 45 shows the path of the threads in the structural member of FIGS. 32 to 35.

MORE DETAILED DESCRIPTION

Figure 1:
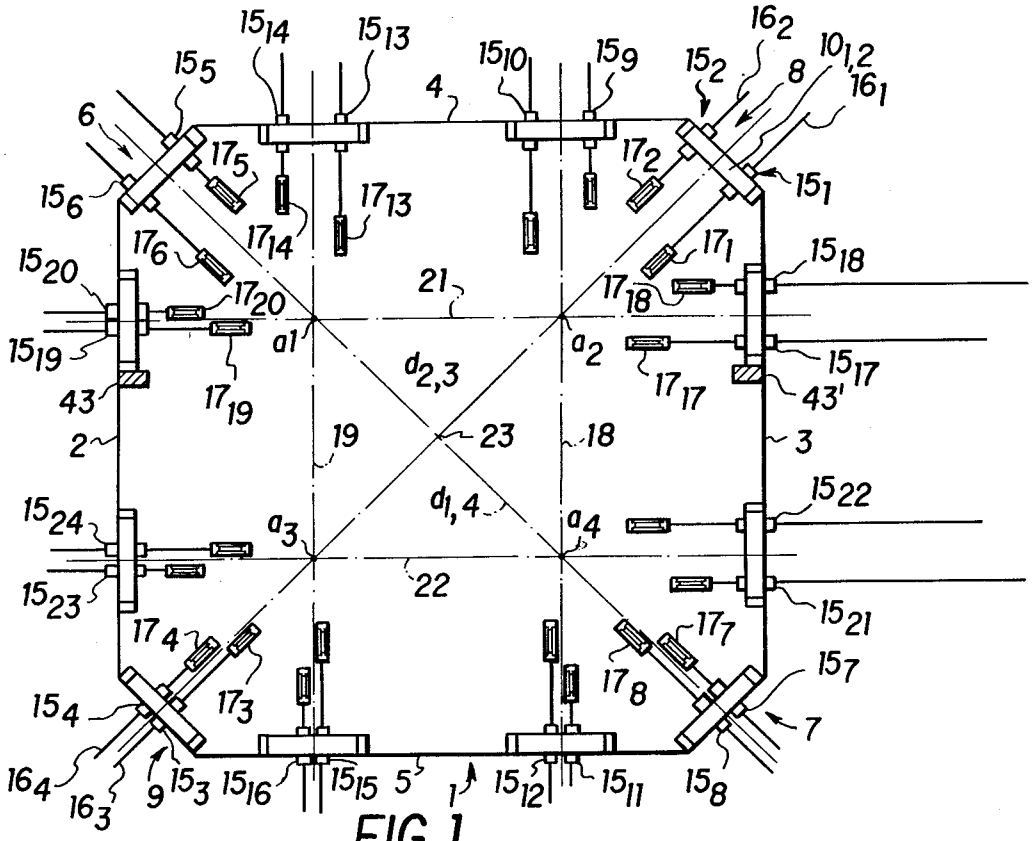
FIG. 1 is a diagrammatic plan view of the spool-carrying plate of a machine for implementing the method of the invention.

In the embodiment shown, the machine for braiding or for stranding comprises a platform or plate 1 (FIGS. 1 and 2) which is generally square in shape with its corners cut off, i.e. it is an irregular octagon having a first pair of parallel long sides 2 and 3, a second pair of parallel long sides 4 and 5 perpendicular to the first pair, and four cut-off corner flats 6, 7, 8 and 9.

This plate or table has through openings for the passage of the cores to be covered, disposed at the vertices al, a2, a3 and a4 of a square concentrical to the table and the sides of which are parallel to the long sides of the table.

A bracket $\mathbf{10}_{1,2}$ running along the corner flat 8 of the plate 1 supports two jacks $\mathbf{15}_1$, $\mathbf{15}_2$, having rods $\mathbf{16}_1$, $\mathbf{16}_2$ which are parallel to the diagonal $d_{2,3}$ passing through the points a2 and a3. Each jack rod 16 serves to displace a corresponding spool device $\mathbf{17}_1$ or $\mathbf{17}_2$ parallel to the said diagonal.

Likewise, the plate 1 supports jacks $\mathbf{15}_3$ and $\mathbf{15}_4$ along the cut-off corner flat 9 opposite to the flat 8 having rods $\mathbf{16}_3$ and $\mathbf{16}_4$ and suitable for displacing corresponding spool devices $\mathbf{17}_3$ and $\mathbf{17}_4$ parallel to the direction of the diagonal $d_{2,3}$.

The spool devices $\mathbf{17}_1$ and $\mathbf{17}_2$ are parallel to each other, and in the condition shown in FIG. 1, are further apart than the overall width of the spool devices $\mathbf{17}_3$ and $\mathbf{17}_4$.

Likewise, the flats 6 and 7 are equipped with respective pairs of jack devices $\mathbf{15}_5$, $\mathbf{15}_6$ and $\mathbf{15}_7$, $\mathbf{15}_8$ which are identical to the jack devices $\mathbf{15}_1$ to $\mathbf{15}_4$. Spool devices $\mathbf{17}_5$ and $\mathbf{17}_6$ are further apart from each other in a direction perpendicular to the diagonal $d_{1,4}$ than the overall width of spool devices $\mathbf{17}_7$ and $\mathbf{17}_8$.

The long side 4 of the plate is fitted with two pairs of jack devices $\mathbf{15}_9$, $\mathbf{15}_{10}$ and $\mathbf{15}_{13}$, $\mathbf{15}_{14}$. The opposite side 5 of the plate 1 is fitted with two pairs of jack devices $\mathbf{15}_{11}$, $\mathbf{15}_{12}$ and $\mathbf{15}_{15}$, $\mathbf{15}_{16}$. The long side 3 of the plate is fitted with two pairs of jack devices $\mathbf{15}_{17}$, $\mathbf{15}_{18}$ and $\mathbf{15}_{21}$, $\mathbf{15}_{22}$. The opposite side 2 of the plate 1 is fitted with two pairs of jack devices $\mathbf{15}_{19}$, $\mathbf{15}_{20}$ and $\mathbf{15}_{23}$, $\mathbf{15}_{24}$. The spacings of opposite pairs of these long side jacks are different in the same manner as already described with respect to the diagonally opposite pairs of jacks $\mathbf{17}_1$, $\mathbf{17}_2$ and $\mathbf{17}_3$ and $\mathbf{17}_4$. The plane of symmetry 18 common to the jacks $\mathbf{15}_9$, $\mathbf{15}_{10}$ and $\mathbf{15}_{11}$, $\mathbf{15}_{12}$ passes through the points a2 and a4. The plane of symmetry 19 common to the jacks $\mathbf{15}_{13}$, $\mathbf{15}_{14}$ and $\mathbf{15}_{15}$, $\mathbf{15}_{16}$ passes through the points al and a3. The plane of symmetry 21 common to the jacks $\mathbf{15}_{17}$, $\mathbf{15}_{18}$ and $\mathbf{15}_{19}$, $\mathbf{15}_{20}$ passes through the points al and a2. The plane of symmetry 22 common to the jacks $\mathbf{15}_{21}$, $\mathbf{15}_{22}$ and $\mathbf{15}_{23}$, $\mathbf{15}_{24}$ passes through the points a3 and a4.

Figure 2:
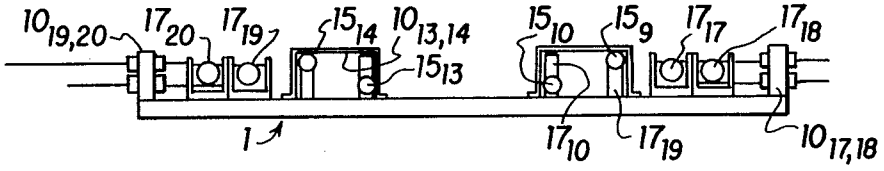
FIG. 2 is an elevation view of the rear of the plate, with some items omitted.

In the condition of the plate 1 shown in FIG. 2, the axes of the jack rods in any pair are at different heights above the plate: for example, the axis of the jack $\mathbf{15}_{14}$ is further from the top surface 20 of the plate 1 than is the axis of the jack $\mathbf{15}_{13}$.

Figure 3:
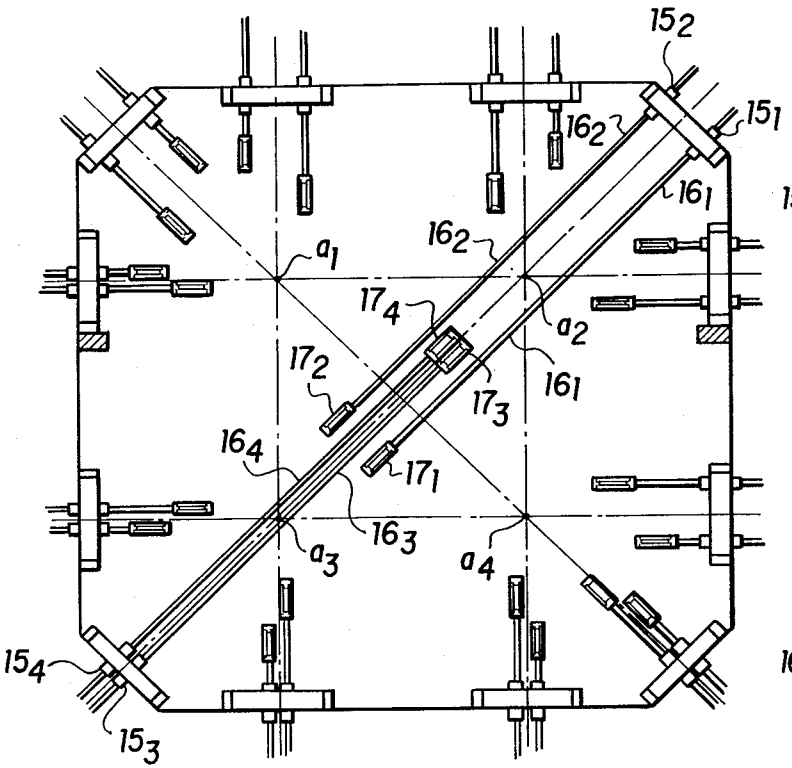

Starting from an initial condition as shown in FIG. 1 at a "Time 0", a first step of machine operation concerns displacing the spool devices which are moved by simultaneously actuating the jacks $\mathbf{15}_1$, $\mathbf{15}_2$ and $\mathbf{15}_3$, $\mathbf{15}_4$ to bring the spool devices $\mathbf{17}_1$, $\mathbf{17}_2$ and $\mathbf{17}_3$, $\mathbf{17}_4$ to the positions shown in FIG. 3 at the end of the first step, i.e. at "Time 1". These four spool devices are moved towards each other and cross the intervening diagonal a1–a4 in opposite directions.

Figure 4:
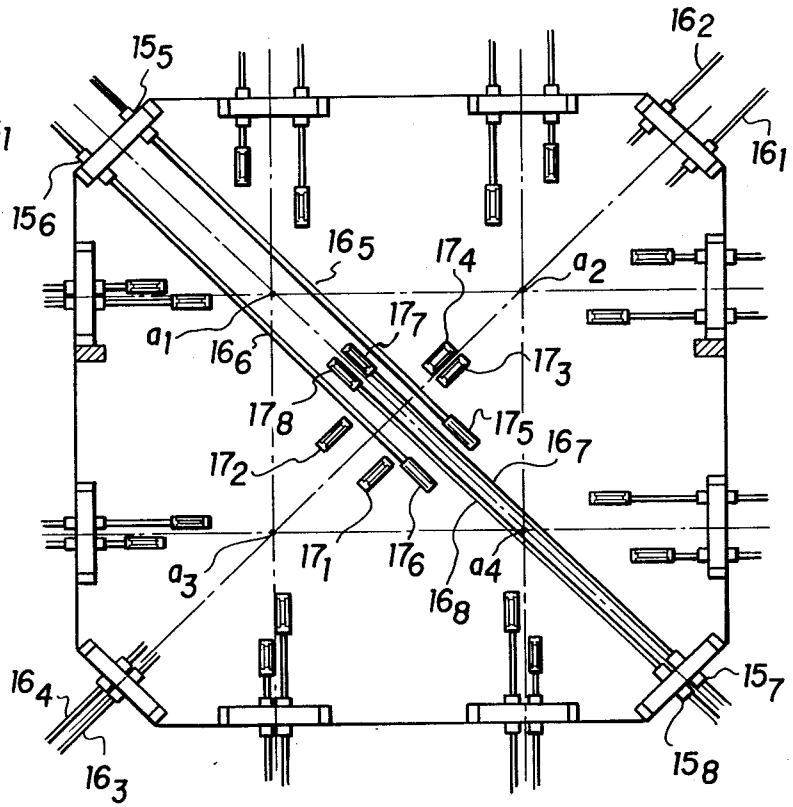
FIGS. 3 to 6 are views analogous to FIG. 1 with the spool devices in various other conditions.

During the next step, after the jack rods $16_1$, $16_2$, $16_3$ and $16_4$ have been retracted, the jack devices $15_5$, $15_6$ and $15_7$, $15_8$ are actuated to put the corresponding spools 17 in the positions shown in FIG. 4 at "Time 2". These movements are parallel and in opposite directions, causing the spools 17 to cross the intervening diagonal a2–a3 which has been left free by retracting the jack rods $16_1$–$16_4$. In the position shown in FIG. 4, the spools $17_7$ and $17_8$ are located in between the jack rods $16_5$ and $16_6$. These spools $17_7$ and $17_8$ are in the same relative disposition as the spools $17_3$ and $17_4$, but offset therefrom by a counterclockwise rotation through 90°. The positions of the spools $17_5$ and $17_6$ are likewise similarly positioned to the spools $17_1$ and $17_2$, but are offset therefrom by a counterclockwise rotation through 90°. The jack rods $16_5$–$16_8$ are then retracted.

Figure 5:
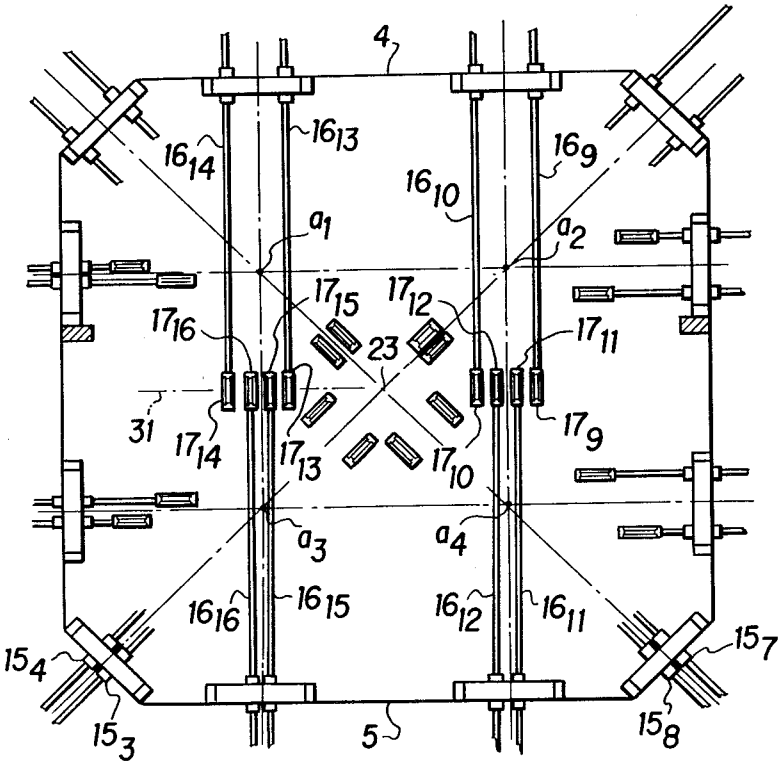

The final position of the following step is shown as "Time 3" in FIG. 5. Eight jack rods are operated during this step simultaneously: i.e. rods $16_9$, $16_{10}$, $16_{11}$, $16_{12}$, $16_{13}$, $16_{14}$ and $16_{15}$, $16_{16}$. The axes of the corresponding spools are then in a common plane 31 passing through the center 23 of the plate 1 and parallel to its long sides 4 and 5. The jack rods $16_9$–$16_{16}$ are then retracted to their initial positions.

Figure 6:
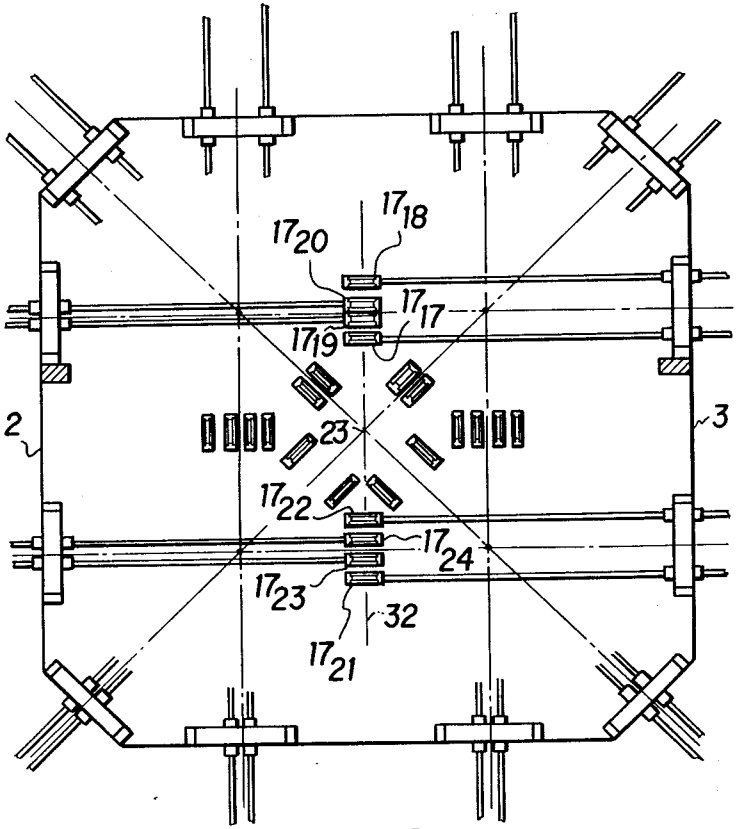

The final position of the next step is shown as "Time 4" in FIG. 6. In this case, the spools 17 having index numbers 17 to 24 are put into their respective central positions with their axes lying on a common plane 32 passing through the center 23 of the plate 1 and parallel to its long sides 2 and 3. At the end of this step, as at the end of the preceding steps, the corresponding jack rods 16 having index numbers 17 to 24 are retracted to their initial positions.

Figure 7:
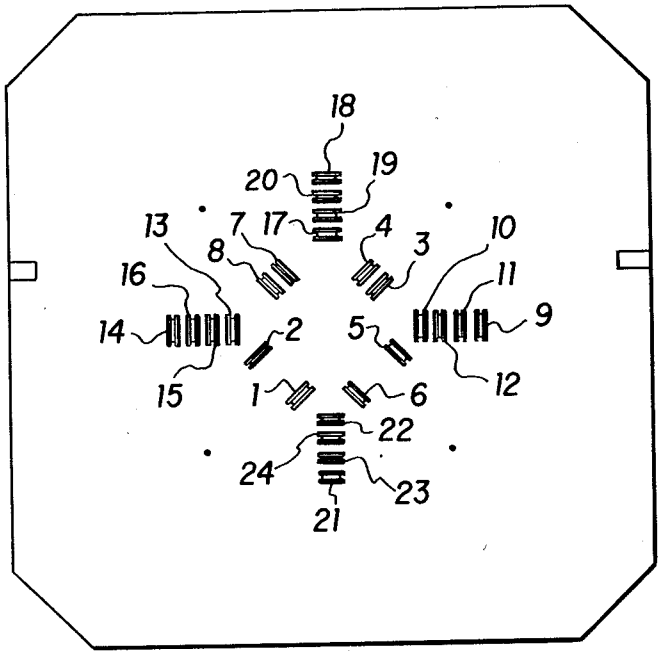
FIG. 7 is a view of the plate with all the spools shown being in their central positions, and with some items being omitted.

The resulting position is shown in FIG. 7 as "Time 5", in which all the spools are in their central positions and none of the jack rods lies over the portion of the plate 1 intended for spool device displacement.

This position corresponds to the end of the first half period of machine operation.

Figure 8:
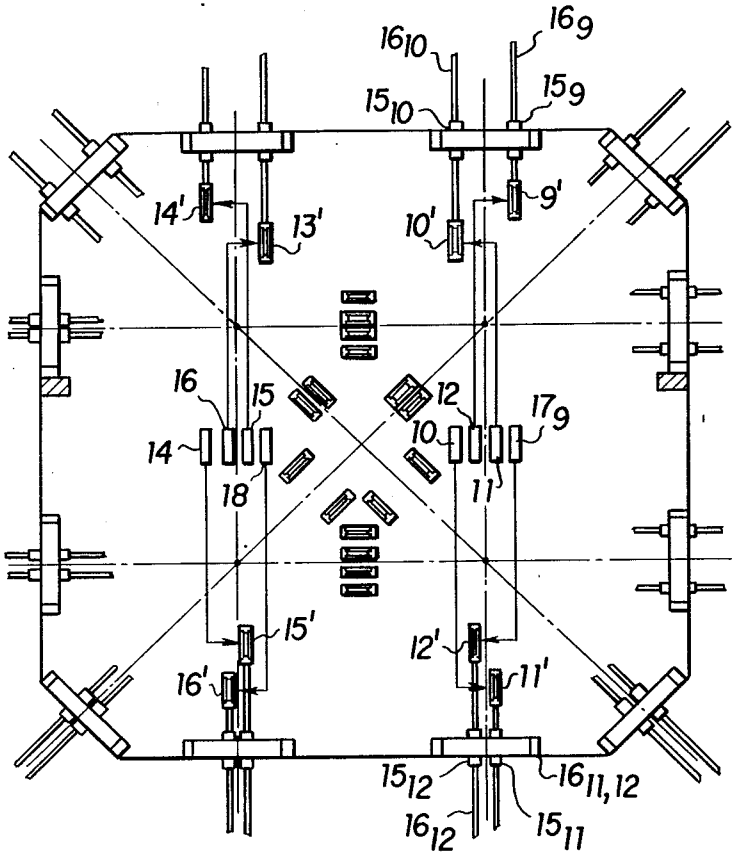

The following step illustrated in FIG. 8 is the first spool device return step. During this step, the jack rod $16_{12}$ is moved in its bracket $10_{11,12}$ to come opposite to the spool device $17_9$, and is then extended to come into contact with the spool device $17_9$ and to hook on to it. The jack rod is then returned into the jack $15_{12}$ and is again moved sideways in its bracket $10_{11,12}$ to return to its initial position. This has the effect of causing the spool $17_9$ to follow the path marked by an arrow in FIG. 8, which path is generally L-shaped, having an initial longitudinal arm followed by a transverse arm that brings the spool device $17_9$ into a position marked 12′ which was the initial position of the spool $17_{12}$.

Likewise and simultaneously the spool device $17_{10}$ is brought to the starting point 11′ by an L-shaped movement as shown by arrow 10-11′. These two motions can take place simultaneously by the jacks $15_{11}$ and $15_{12}$ being at different heights. The spools 9 and 10 are thus moved to the positions which were initially occupied by the spools 11 and 12. Likewise, the spools 11 and 12 are moved by the jack rods $16_{10}$ and $16_9$ respectively from their central positions to positions 10′ and 9′ which were initially occupied by the spools 10 and 9.

During the same step, the spool 13 is moved from its central position to the position 16′ which was initially occupied by the spool 16 and the spool 14 is moved from its central position to the position 15′ which was initially occupied by the spool 15. Likewise, the spool 15 is moved to 14′ which was initially occupied by the spool 14 and the spool 16 is moved to the position 13′ which was initially occupied by the spool 13.

At the end of this step, the spools are in the position shown in FIG. 8 as "Time 6".

Figure 9:
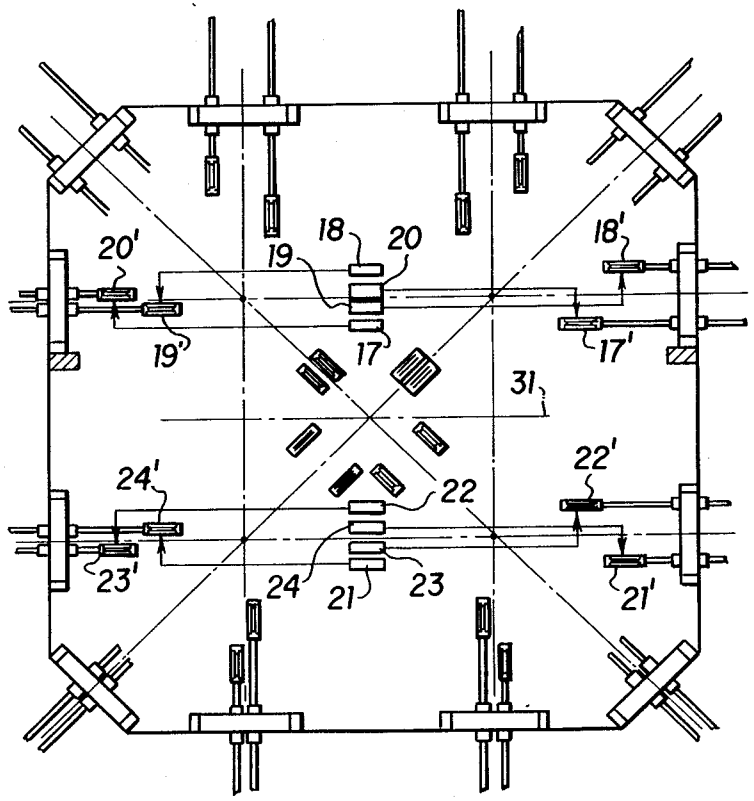

FIG. 9 relates to the next step. This step is substantially the same as the previous step, except that it is the spools 17 to 24 which are swapped in pairs by moving along paths which are perpendicular to those used to swap the spools 9 to 16 in pairs. In other words the spool 18 is moved to the initial position 19′ of the spool 19, the spool 17 is moved to the initial position 20′ of the spool 20, the spool 20 is moved to the initial position 17′ of the spool 17 and the spool 19 is moved to the initial position 18′ of the spool 18.

At the same time the spool 22 is moved to the initial position 23′ of the spool 23, the spool 21 is moved to the initial position 24′ of the spool 24, the spool 24 is moved to the initial position 21′ of the spool 21 and the spool 23 is moved to the initial position 22′ of the spool 22.

At the end of this step, the spools are in the positions shown in FIG. 9 as "Time 7".

Figure 10:
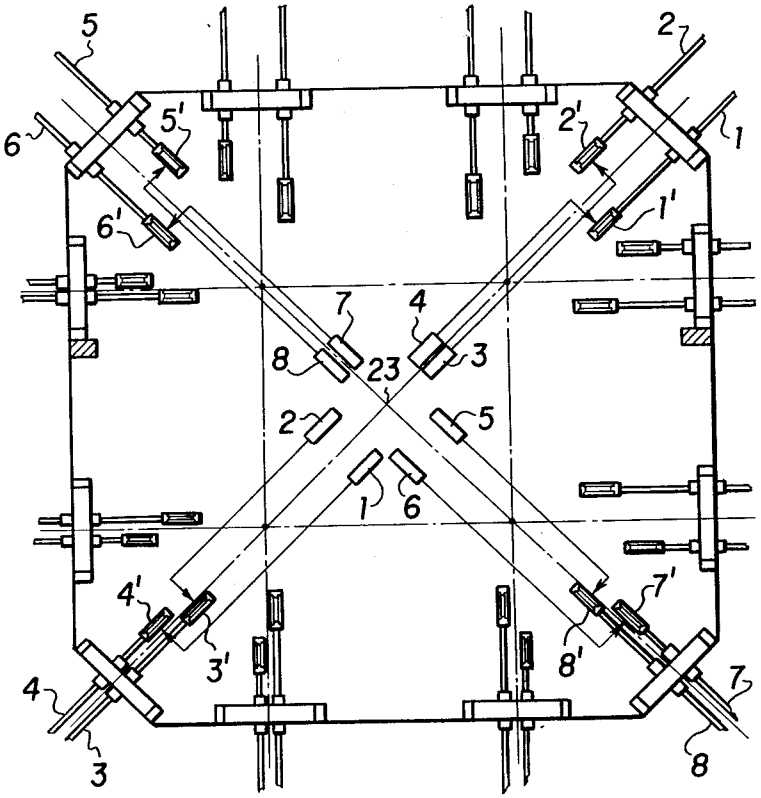
FIGS. 8 to 10 are views similar to FIGS. 3 to 6, but for other positions of the spool devices.

During the next step as shown in FIG. 10, the diagonally moved spools are swapped in pairs along the a2–a3 diagonal as follows :

spool 1 is moved to the initial position 4′ of spool 4;
spool 2 is moved to the initial position 3′ of spool 3;
spool 3 is moved to the initial position 2′ of spool 2; and
spool 4 is moved to the initial position 1′ of spool 1.

Similarly, and at the same time since there is no need to extend the jack rods more than half way across the plate 1, spools are swapped in pairs along the a1–a4 diagonal as follows :

spool 5 is moved to the initial position 8′ of spool 8;
spool 6 is moved to the initial position 7′ of spool 7;
spool 7 is moved to the initial position 6′ of spool 6; and
spool 8 is moved to the initial position 5′ of spool 5.

At the end of this step, the spools are in the positions shown in FIG. 10 as "Time 8". However, this position is the same as the initial position, except that the spools have been swapped in substantially symmetrical pairs about the center 23 of the plate or about one of the planes 31 or 32 as the case may be.

Figure 12:
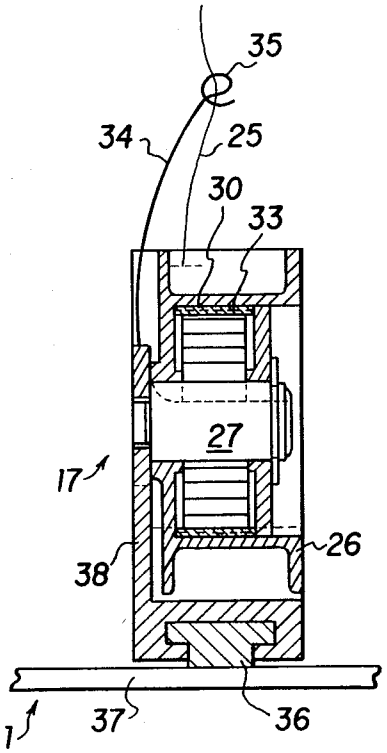
FIG. 12 is a section on a line XII—XII in FIG. 11.
Figure 11:
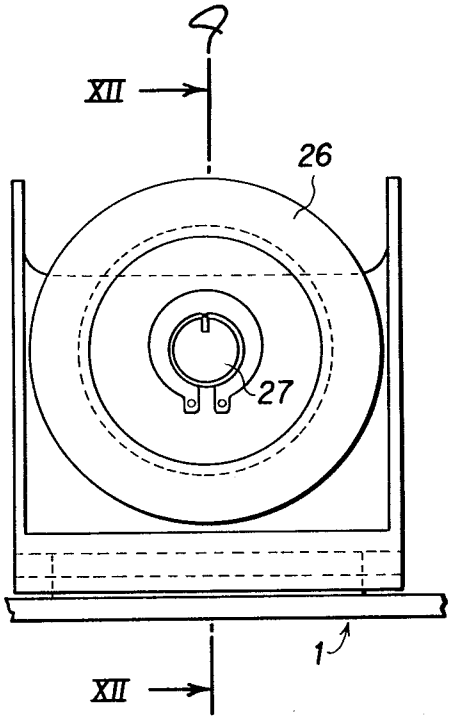
FIG. 11 is an elevation view of a spool and of the adjacent items to a larger scale.

Each spool device 17 (see FIGS. 11 and 12) comprises a spool body 26 which is rotatable about a shaft 27 mounted on a body 38. A flat spiral spring 30 rubs against the rim 33 of the spool 26, and also provides resilieht return means therefor. A metal wire 34 having a loop 35 serves to guide the thread 25 to be braided as it leaves the spool 26. In the central position of each spool device 17, when released from the jack rods, the body 26 holds the spool fixed to the plate 1 by receiving a length of tongue 36 fixed to the upper surface 37 of the plate 1.

In another embodiment of the machine, the spool devices are moved manually. The spool devices are then guided by grooves or rails such as 101 and 102 shown in FIG. 39, which grooves or rails are provided in or on a plate 103 lying over the plate 1 and connected thereto by spacers 104.

Figure 40:
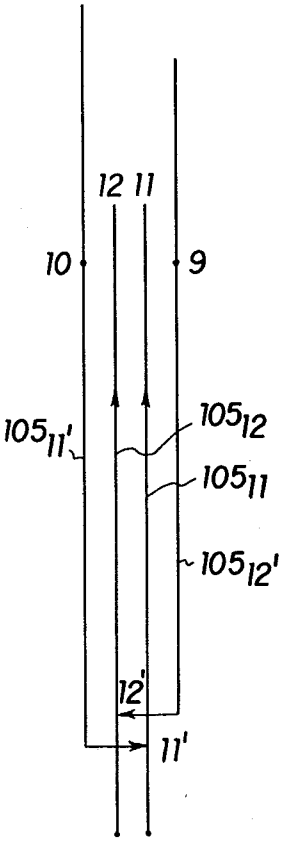
FIG. 40 is a diagrammatic view of the path of a spool device.

FIG. 40 is a diagram showing the path $105_{11}$ of the spool 11 during the first half period and the path $105_{12}$ of the spool 12 during the first half period. These two paths are rectilinear.

During the second half period the spools 9 and 10 are moved respectively to the initial positions 12' and 11' of the spools 12 and 11 via paths $105_{12'}$ and $105_{11'}$. In this embodiment, these paths are L-shaped.

Figure 41:
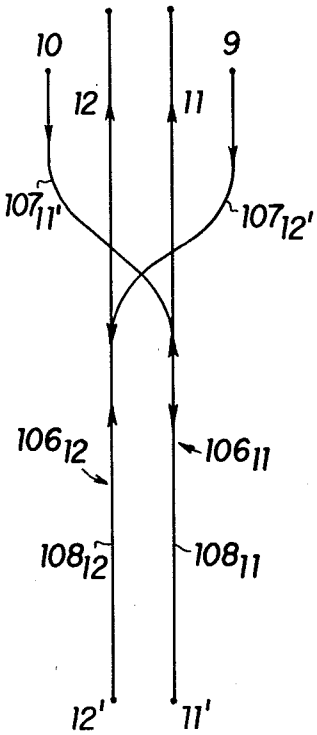
FIG. 41 is a similar view to FIG. 40, but showing a variant in which the spool devices are displaced manually.

FIG. 41 shows a variant in which the path $106_{11}$ is identical to the path $105_{11}$, but in which during the second half period the spool device 10 is moved to the outer end $108_{11}$ of the path $106_{11}$ to the position 11' by following a curved path 10711'. Similarly, the spool 9 is moved to the end 10812 of the path $106_{12}$ to the position 12' via a curved path 10712'.

Figure 42:
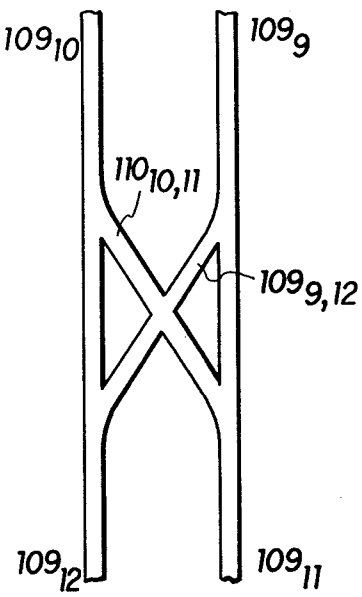
FIG. 42 is a diagram relating to a variant of the FIG. 41 embodiment.
Figure 39:
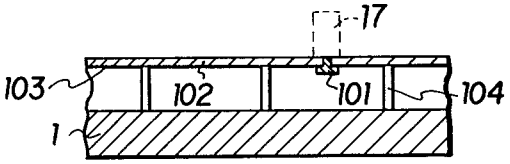
FIG. 39 is a diagrammatic section through an embodiment of the machine in which the spool devices are manually driven.

FIG. 42 is a plan view of the spool-guiding grooves 102 shown in the FIG. 39 embodiment. Grooves $109_{11}$ and $109_9$ are in line, as are grooves $109_{12}$ and $109_{10}$. The groove $109_{10}$ is connected to the groove $109_{11}$ via a doubly curved switching groove $110_{10,11}$ and the groove $109_9$ is connected to the groove $109_{12}$ via a doubly curved switching groove $109_{9,12}$.

Switching devices may be provided to co-operate with the switching grooves.

In a variant, the spool device may be held to the plate 1 by magnetic means.

Figure 14:
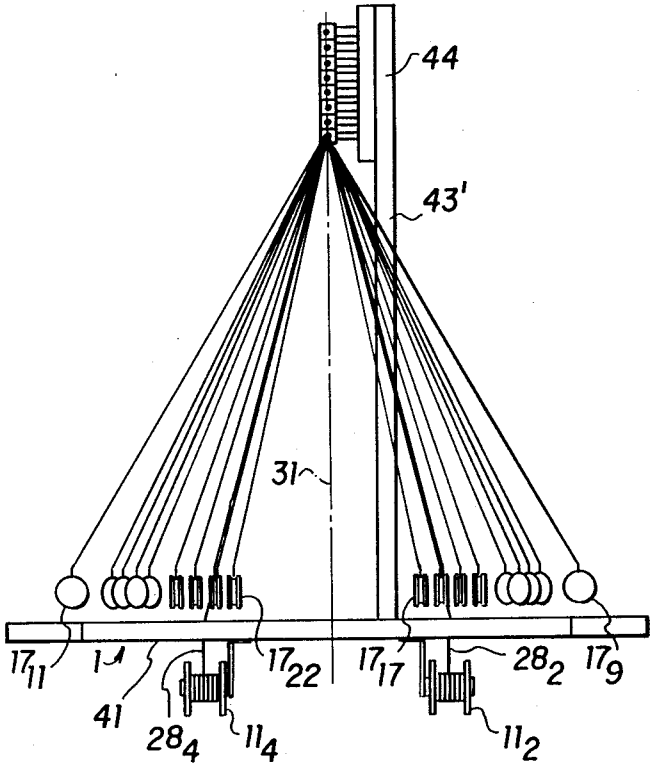
FIG. 14 is a corresponding diagrammatic side elevation view.
Figure 13:
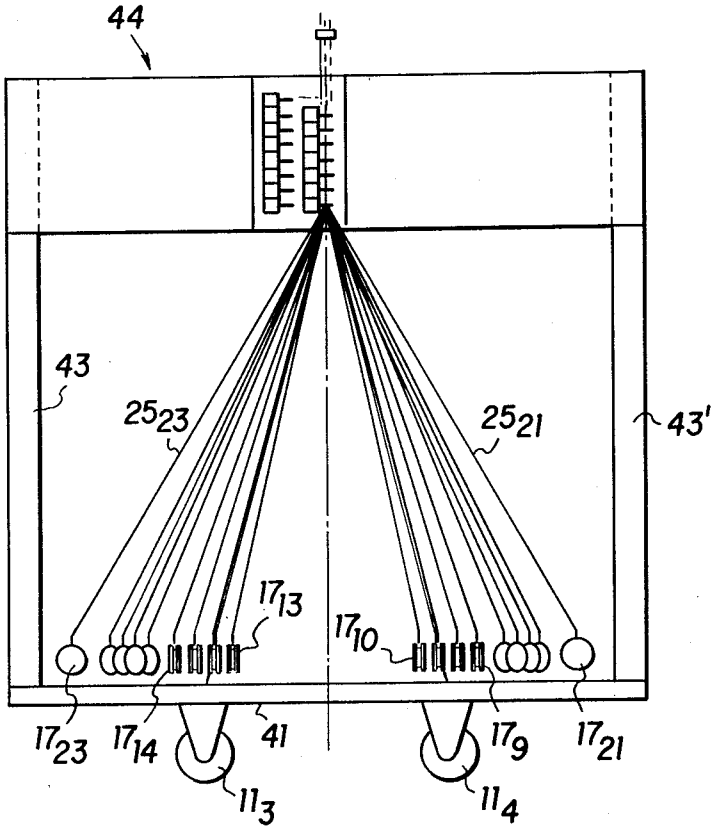
FIG. 13 is a diagrammatic front elevation of the machine.

The bottom face 41 of the plate 1 has brackets which support drums $11_1$–$11_4$ from which the cores $28_1$–$28_4$ are unreeled to pass through holes in the plate 1 at the corners a1–a4 respectively (see FIGS. 13 and 14).

Risers 43, 43' are mounted on the plate 1 and support a panel 44 extending over the distance between the sides 2 and 3 of the plate 1. The panel 44 has a two-part guide device 45 (see FIGS. 15 and 16) fixed thereto and providing first and second guide paths 46 and 47. Both of these paths are intended to guide mandrel devices 48 (see FIGS. 17 and 18) each of which has a base 49 for guidance purposes and a mandrel support 51 connected thereto via a neck 52. The mandrel supports are prismatic and of square section to enable them to be stacked with their top and bottom faces 54 and 53 respectively coming into contact.

A mandrel 55 projects away from a face 56 of each mandrel support. In the embodiment shown, each mandrel is of octogonal cross section and thus has eight faces $57_1$ to $57_8$, together with a front end face 58.

Means are provided, as indicated by a broad arrow 1 (FIG. 15) for moving the bottom mandrel of the row 47 to the bottom position of the row 46, which position is aligned with the position of the next-to-bottom mandrel support in the row 47. This movement follows an L-shaped path indicated by arrow 59. Means are also provided, as indicated by a broad arrow 3, for moving the top mandrel support from the row 46 to the top of the row 47 once the top of the row 47 is left vacant by the mandrel supports in said row moving down one position as indicated by a broad arrow 2.

Figure 16:
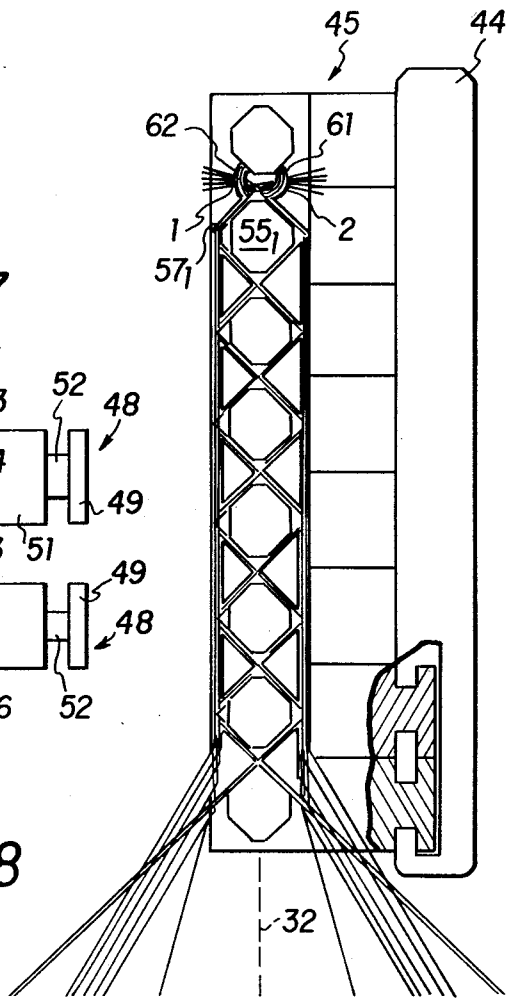
FIG. 16 is a partially cut-away corresponding side view.

In order to manufacture a frame element, threads $25_1$–$25_{24}$ are drawn by hand from the spools $17_1$–$17_{24}$ while in their initial positions (FIG. 1) and at the same time the four cores $28_1$–$28_4$ are also drawn. The threads and the cores coming from one side of the plane 31, e.g. from the left hand side as shown in FIG. 16 are clamped and held fast in a clamping member 61 situated to the right of the said plane, and the last portion of their path brings them into contact with the face $57_1$ of the mandrel $55_1$. Likewise, the threads 25 from the right hand side of the plane 31 together with the cores $28_2$ and $28_4$ drawn off their drums are clamped and held fast in a clamping device 62 on the left of the plane 31 and immediately adjacent to the face $57_3$ of the mandrel $55_1$. A sort of tent-shaped cone is thus established beneath the mandrel $55_1$ by the ends of the twenty-four threads $25_1$–$25_{24}$ together with a second, smaller tent constituted by the four cores $28_1$–$28_4$. This "tent" configuration is shown in FIG. 16 at the start of manufacturing a length of the structure member corresponding to a period of operation of the machine other than the first period, which first period is performed when the mandrel $55_1$ is at the bottom of the row 46.

The threads 25 are relatively flexible in their "tent" while the cores 28 are relatively rigid. Thus the above-described movements of the spools $17_1$–$17_{24}$ provide oblique lengths of covering or winding thread.

Figure 20:
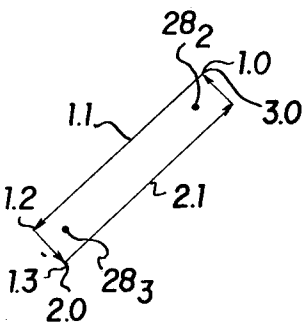
FIG. 20 is a corresponding plan view.
Figure 19:
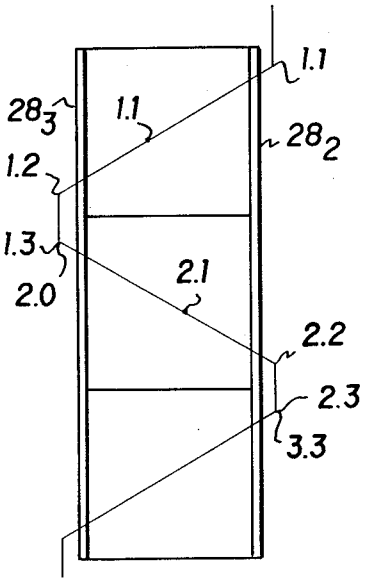
FIG. 19 is a diagrammatic elevation view for explaining how a winding is formed.

In the initial condition, i.e. at "Time 0", the position of the thread $25_2$ may be represented by the point 1.0 in FIGS. 19 and 20. As the spool device or spool $17_2$ moves to the position occupied at "Time 1", it establishes a length of thread running from point 1.0 to point 1.1. The configuration of the thread $25_2$ relative to the cores $28_2$ and $28_3$ is not modified so long as the spool $17_1$ remains stationary on the plate 1, i.e. until "Time 6". In the next step after "Time 6", the spool $17_2$ is moved again: the longitudinal movement of the spool corresponds to the thread following a path from point 1.1 to a point 1.2, and its transverse movement corresponds to the thread following a path from the point 1.2 to a point 1.3. The thread does not pause at the point 1.2, but is run from point 1.1 to point 1.3 in a single step. The first period is now over.

During the second period, the thread $25_2$ takes up a similar position around the cores $28_3$ and $28_2$ from a point 2.0 (the same as the point 1.3) to a point 2.3 via points 2.1 and 2.3. As before, the thread covers the portion 2.1 to 2.2 to 2.3 (which becomes a starting point 3.0 for the next period) during the second half only of the second period. The point 3.0 is the same as the point 1.0, but further down the cores.

It can thus be seen that during each period, the thread moves round one side or the other of the plane defined by the cores $28_2$ and $28_3$ and that two successive periods serve to wind one oblique turn of the thread around the cores. Such a turn may be considered as being a single turn of a flat helical winding around the longitudinal cores $28_2$ and $28_3$.

At the same time as the thread $25_2$ is being wound round the cores $28_2$ and $28_3$, the thread $25_1$ is also being wound round the same cores, but during each period the threads $25_1$ and $25_2$ are located on opposite sides thereof.

Similarly, the threads $25_3$ and $25_4$ are simultaneously wound around the cores $28_2$ and $28_3$ (i.e. around the cores a2 and a3) but they slope in the opposite directions to the threads $25_1$ and $25_2$.

The threads $25_1$ and $25_2$ are initially further apart than are the threads $25_3$ and $25_4$, and then the threads $25_3$ and $25_4$ are further apart than are the threads $25_1$ and $25_2$, and so on in alternation, such that the thread $25_1$ alternately crosses the thread $25_3$ on the outside and then on the inside, and then on the outside, etc.

Figure 43:
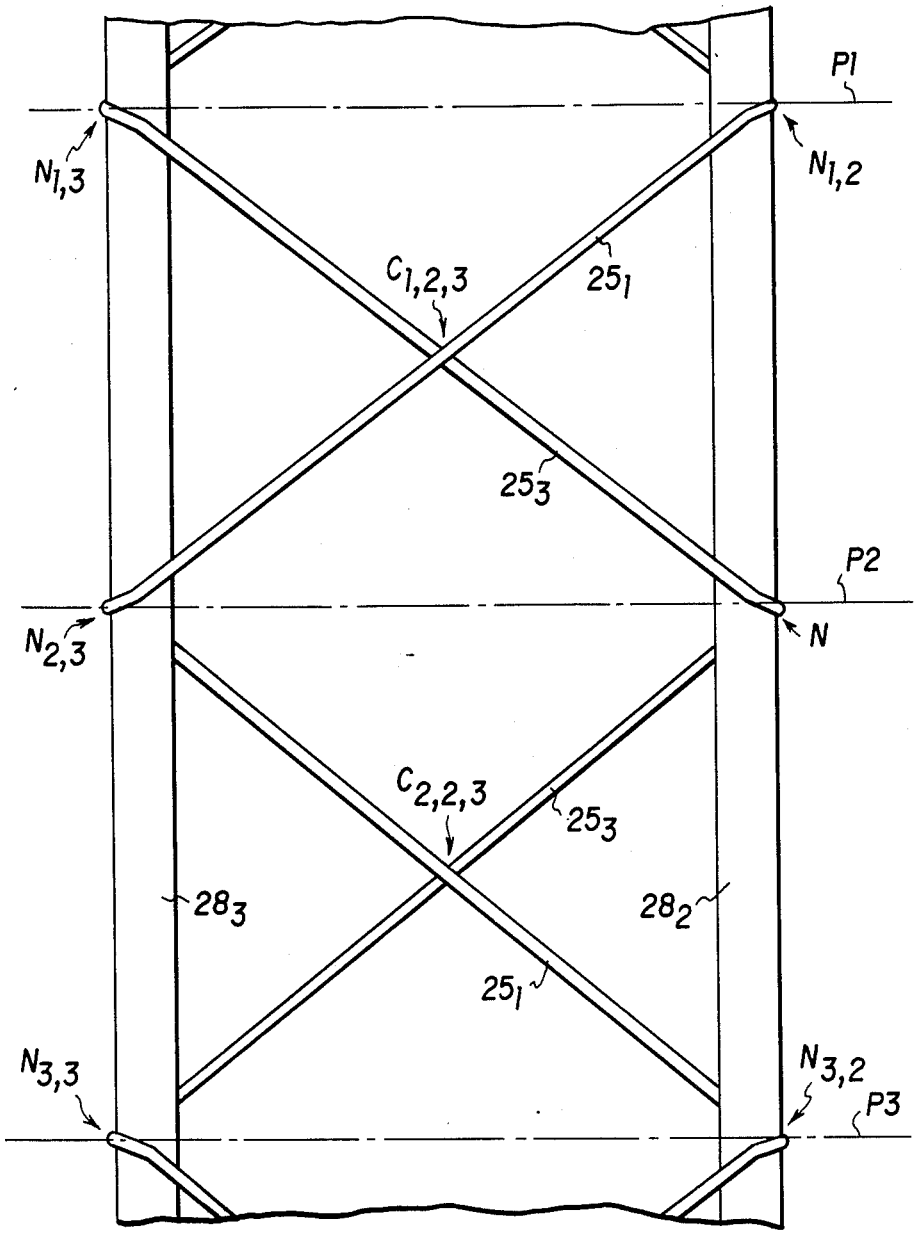
FIG. 43 shows the configuration of two threads wound around two cores and crossing each other alternatively on both sides of the plane of the two cores.

This relation is illustrated in FIG. 43 in which, for the sake of clarity, only threads $25_1$ and $25_3$ and the cores $28_2$ and $28_3$ around which they are wound are represented. These threads come into contact with the cores at nodes lying in node planes P1, P2, P3 transverse to the longitudinal direction of the cores and uniformy spaced in this direction. The thread $25_1$ travels from a node $N_{1,2}$ lying in the node plane P1 and on the core $28_2$ to a node $N_{2,3}$ lying in the node plane P2 and on the core $28_3$, passing in front of the cores as seen in the Figure, i.e. on the side of the plane containing the axes of the cores $28_2$ and $28_3$ where the core $28_4$is. The thread $25_3$ travels from a node $N_{1,3}$ lying in a plane P1 and on the core $28_3$ to a node $N_{2,2}$ lying in the plane P2 and on the core $28_2$, also passing in front of the cores. The two threads cross each other in a crossing point $C_{1,2,3}$ lying substantially halfway between planes P1 and P2 and halfway between cores $28_2$ and $28_3$. At this crossing point, the thread $25_1$ lies in front of the thread $25_3$ as seen in the Figure, i.e. outside of the thread $25_3$ or further than the latter from the plane containing the axes of the cores $28_2$ and $28_3$.

Between the node planes P2 and P3, the threads $25_1$ and $25_3$ pass at the rear of the cores $28_2$ and $28_3$, i.e. on the side where the core $28_1$ is. They cross each other in a crossing point $C_{2,2,3}$ where the thread $25_1$ lies this time inside of the thread $25_3$ or nearer than the latter from the plane defined by the axes of the cores $28_2$ and $28_3$. Between the plane P3 and the following node planes, the same configuration than between the planes P1 and P2 is reproduced, the distance between two following node planes, which represents the length of the structural member manufactured during a period of operation of the machine, corresponding to the half pitch of winding of the threads.

The thread $25_2$ passes through the same nodes as the thread $25_1$ and the thread $25_4$ passes through the same nodes as the thread $25_3$, but the threads $25_2$ and $25_4$ cross each other at the rear of the cores at the crossing points such as $C_{1,2,3}$ where the threads $25_1$ and $25_3$ cross each other in front of the cores, and vice versa.

The threads $25_1$ and $25_4$ are wound along flattened helices of the same winding direction (downwards and clockwise), but offset longitudinally of a half pitch with respect to each other. The threads $25_2$ and $25_3$ are wound along flattened helices of the same winding direction, opposite to the winding direction of the threads $25_1$ and $25_4$, and also offset by a half pitch.

Turns of the threads $25_5$ to $25_{24}$ are wound around corresponding pairs of the cores $28_1$ to $28_4$ in the same manner, except that instead of winding helical turns around the diagonally opposite pair of cores $28_2$ and $28_3$ as described above, the threads $25_5$ to $25_8$ are wound around the other diagonally opposite pair of cores $28_1$ and $28_4$, the threads $25_9$ to $25_{13}$ are wound around the pair of cores $28_2$ and $28_4$, the threads $25_{13}$ to $25_{16}$ are wound around the pair of cores $28_1$ and $28_3$, the threads $25_{17}$ to $25_{20}$ are wound around the pair of cores $28_1$ and $28_2$, and the threads $25_{21}$ to $25_{24}$ are wound around the pair of cores $28_3$ and $28_4$.

Consequently, during two successive periods, each of the threads is wound, by virtue of the displacements of the spool from which it is unwound, round one helical turn about a pair of cores. The cores may be diagonally opposite or otherwise, and the threads cross one another alternating each half turn between crossing on the inside and crossing on the outside. The result is a three-dimensional braid or strand.

Figure 44:
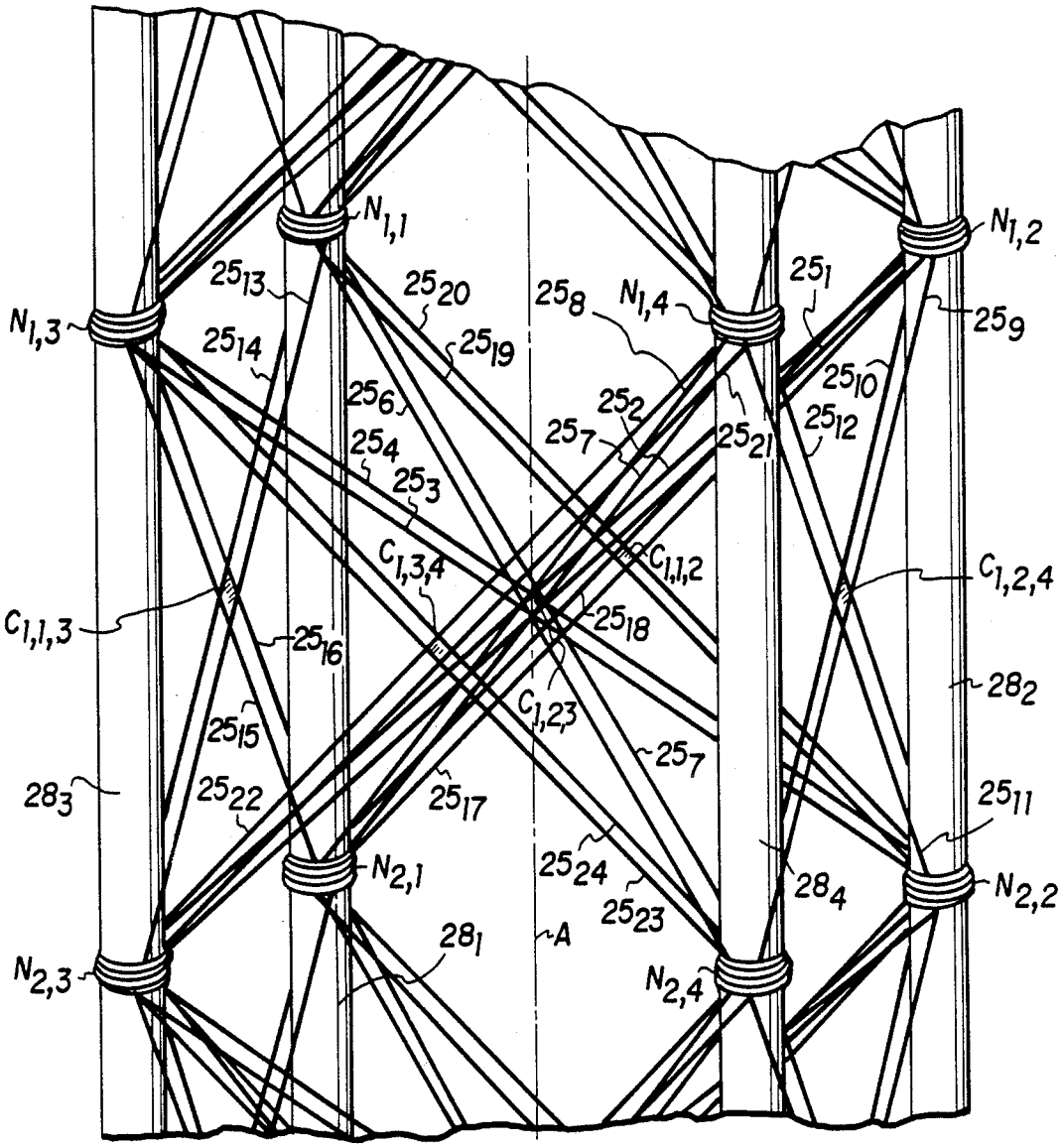
FIG. 44 is a part view in prespective showing the configuration of twenty-four threads wound around four primary cores in a structural member in accordance with FIGS. 23 to 26.

FIG. 44 shows the configuration of the twenty-four threads $25_1$ to $25_{24}$ along the four cores $28_1$ to $28_4$ between two successive node planes P1 and P2 (not shown on the Figure).

As described in relation with FIG. 43, the threads $25_1$ and $25_2$ extend between node $N_{1,2}$ lying in the plane P1 on the core $28_2$ and node $N_{2,3}$ lying in the plane P2 on the core $28_3$, and the threads $25_3$ and $25_4$ extending between node $N_{1,3}$ lying in the plane P1 on the core $28_3$ and node $N_{2,2}$ lying in the plane P2 and on the core $28_2$, these four threads crossing one another in a crossing point $C_{1,2,3}$ lying at the center of the rectangle $N_{1,3}$, $N_{1,2}$, $N_{2,2}$, $N_{2,3}$.

The positions of the threads $25_5$ to $25_8$ result from a rotation of 90° in the counterclockwise direction around the central longitudinal axis A of the structure, applied to the respective positions of the threads $25_1$ to $25_4$. In this rotation, the cores $28_2$ and $28_3$ and the nodes $N_{1,2}$, $N_{2,2}$, $N_{1,3}$ and $N_{2,3}$ have respectively the cores $28_1$ and $28_4$ and the nodes $N_{1,1}$, $N_{2,1}$, $N_{1,4}$ and $N_{2,4}$ as images.

The threads $25_5$ to $25_8$ also cross one another at point $C_{1,2,3}$ through which eight threads pass in the whole.

Relative dispositions of the threads similar to the ones of the threads $25_1$ to $25_4$ and $25_5$ to $25_8$ in the diagonal planes of the square-based prism the edges of which are occupied by the cores $28_1$ to $28_4$ are to be found in the four faces of this prism.

In particular, the relative disposition of the threads $25_1$ to $25_4$ respectively, as viewed from the core $28_4$, are reproduced, as viewed from the outside of the prism :

for the threads $25_9$ to $25_{12}$ in the face containing the cores $28_2$ and $28_4$;

for the threads $25_{16}$, $25_{15}$, $25_{14}$ and $25_{13}$ in the face containing the cores $28_1$ and $28_3$;

for the threads $25_{20}$, $25_{19}$, $25_{18}$ and $25_{17}$ in the face containing the cores $28_1$ and $28_2$; and for the threads $25_{21}$ to $25_{24}$ in the face containing the cores $28_3$ and $28_4$.

These four groups of four threads cross respectively at points $C_{1,2,4}$, $C_{1,1,3}$, $C_{1,1,2}$ and $C_{1,3,4}$, which lie, as the point $C_{1,2,3}$, halfway between the node planes P1 and P2.

The particular disposition of the spools on the plate, and the movements performed by the spools are selected as a function of the required characteristics of the resulting structural member, depending on the forces it is intended to withstand.

Figure 15:
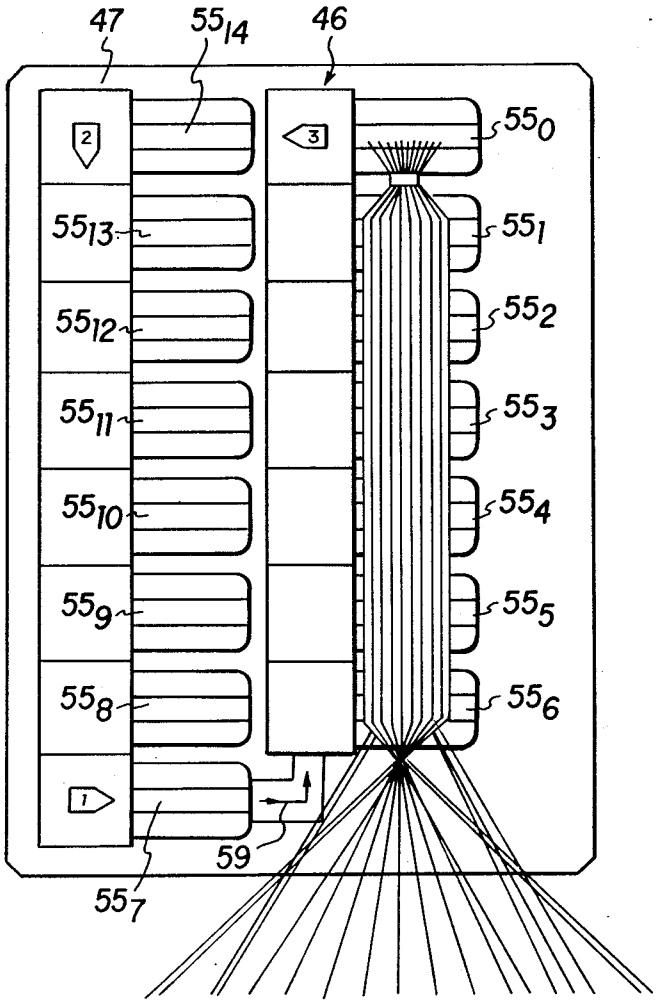
FIG. 15 is a front view to a larger scale of panel carrying mandrel supports.

When the strand length corresponding to one mandrel is completed, e.g. corresponding to the mandrel $55_6$ in FIG. 15, i.e. after the spools have performed two successive periods of displacements corresponding to a half pitch of winding of the threads, another mandrel, in this case the mandrel $55_7$, is taken from the bottom of the row 4 and is engaged horizontally into the "tents" of threads and cores running from the mandrel $55_6$. Once engaged in the "tents", the new mandrel is raised one step to take up the position previously occupied by the mandrel $55_6$. The stack of mandrels in the row 46 is thus moved up by one step, except for the top mandrel in the row 46, $55_0$, which is moved horizontally to occupy the top position in the other row 47, which position was previously occupied by the mandrel $55_{14}$. The top position is freed by virtue of the mandrels in the row 47 all moving down one step once the bottom mandrel $55_7$ has been moved over to the row 46.

Once the new mandrel $55_7$ has taken the place of the old mandrel $55_6$, the next length of structural member is fabricated by moving the spools 17 over the plate 1 as explained above.

Manufacture then continues by repeating the cycle as often as may be necessary.

Figure 21:
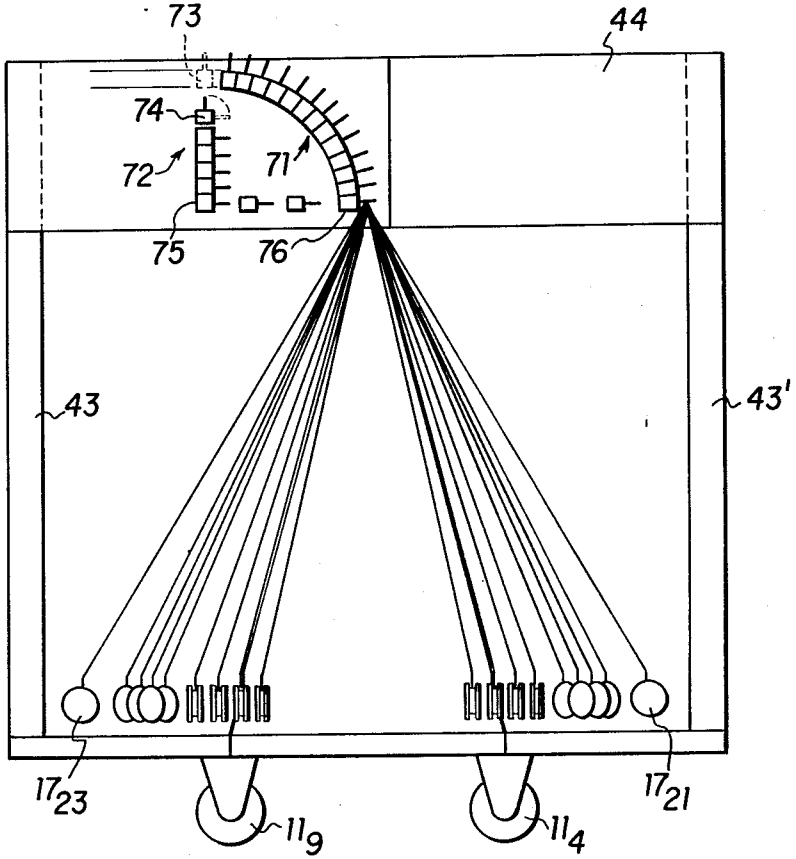
FIG. 21 is a view similar to FIG. 13, but showing another embodiment of the device carrying the mandrel supports.

In one particular embodiment, the mandrel drive device is so shaped as to directly obtain a frame member which is curved as shown in FIG. 21, rather than being rectilinear as shown in FIGS. 13 and 14. The mandrel circuit then includes a curved portion 71, e.g. following an arc of a circle, and a vertical return portion 72. When the mandrel shown at 73 arrives at the end of the path 71, it takes up the top position of the return path 72, as shown at 74. Thereafter it is turned through 90° so that once it arrives at the bottom of the return path, as shown at 75, it may be moved horizontally to be inserted into the bottom of the curved path at 76.

The resulting frame member has substantially the same shape as the curved path 71. This technique may be used to directly manufacture a tennis racket frame.

Figure 22:
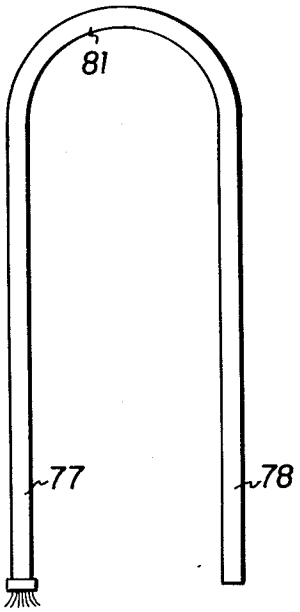
FIG. 22 is a diagrammatic view of a frame member in accordance with the invention.

As shown in FIG. 22, it is also possible to obtain a frame member having two parallel straight arms 77 and 78 which are joined by a curved portion 81.

Once the desired length of frame member has been manufactured, the frame member is separated from the machine by cutting its constituent threads and cores.

FIGS. 23 upwards relate to structural members manufactured by a machine in accordance with the invention.

FIGS. 23 to 27 show a beam having four parallel uprights 129, 131, 132 and 133. These uprights contain the cores $28_1$ to $28_4$ described above, and the threads are helically wound about the cores in the above-described manner.

The beam is of square cross section having four longitudinal faces 111, 112, 113 and 114 each of which includes openings. The beam includes diagonal rungs 115, 116, 117 and 118, face rungs 119, 121, and 122, 123 between the cores $28_3$, $28_4$ and $28_1$, $28_2$ respectively, and side rungs 125, 126, and 127, 128 between the cores $28_1$, $28_3$ and $28_2$, $28_4$ respectively.

Each rung contains the two threads which extend between the nodes lying at the ends of the rung (see FIG. 44). Six pairs of rungs extend between two successive node planes and are disposed respectively along the two diagonals and the four sides of the square section, as seen in the plane of FIG. 24, the two rungs of each pair crossing each other in the manner of the letter X.

The zones where the side rungs cross are referenced 34, 135, 136 and 137. The central zone 138 is where the diagonal rungs cross.

Each of the front faces has octogonal openings 141 left by the mandrels 55, which openings are symmetrical about the mid plane 142 between the parallel faces 113 and 114. Similarly, the side faces have octogonal openings 143 which are symmetrical about the mid plane 140 perpendicular to the mid plane 142. All of these faces include openings on either side of their respective planes of symmetry, 144, 145 and 146, 147 respectively.

These openings are useful for interconnecting a frame member in accordance with the invention to other components of a structure.

At each end of the structure member, there are inclined branches 148, 149; 151, 152 which converge on a small, cross-shaped platform 153. Each end of the structure member has rectangular section appendices 154, 155, 156, 157 disposed in line with its cores.

Reference is now made to FIGS. 28 to 31 relating to another shape of braided beam.

In this beam, the structure member still has four thread-like cores disposed along the corners of a square section prism, said cores being referenced 161 to 164. During manufacture, these cores are surrounded by threads in similar manner to that described above. In addition, the structure member has two groups of parallel additional cores, with five cores in each group. The groups are referenced 165 and 166.

The additional cores of group 165 are aligned between the primary cores 161 and 163, and the threads wound around the latter also pass around group 165. Similarly, the threads wound around the primary cores 162 and 164 pass around the additional cores of group 166.

The completed structural member then includes two solid parallel walls 167 and 168, forming two uprights, and two walls 169 and 171 which are perpendicular thereto and have openings. The openings in the walls 169 and 171 are octogonal in shape as can be seen for the opening 172, or are substantially trapezoidal in shape as shown at 173 and at 174. Each end of the element has two plane platforms 175 and 176 of rectangular section.

The embodiment shown in FIGS. 32 to 35 is a ladder-shaped structural member. It includes two pairs of adjacent thread-shaped cores 181, 182 and 183, 184, forming two parallel uprights 185 and 186 respectively with rungs 187 extending therebetween and with sloping reinforcing struts 188 and 189 between each rung and the adjacent upright. The side faces 191 and 192 do not have any openings.

This ladder-shape can be obtained by means of the same movements of the spools as the members already described, but driving pairs of cores close to each other to form the solid uprights 185 and 186 and leading the threads along a path which is not straight between two nodes lying in successive node planes and lying respectively in the two uprights.

The threads 25 having the indices 1, 2, 7, 8, 17, 18, 21 and 22, represented by a single line $T_1$ in FIG. 45, and which pass through one of the nodes $N_{1,2}$ and $N_{1,4}$ lying adjacent to each other in a node plane P1 and in the upright 186, instead of travelling directly towards nodes $N_{2,1}$ and $N_{2,3}$ lying in the following node plane P2 and in the upright 185, first follow the rung $187_1$ which extends substantially in plane P1, then follow the oblique strut $189_{1,1}$ which connects the rung $187_1$ and the upright 185, and finally reach the nodes $N_{2,1}$ and $N_{2,3}$ following this upright longitudinally. Between the node plane P2 and the following node plane P3, the same threads successively follow the transverse rung $187_2$ extending along the plane P2, the strut $189_{2,1}$ connecting this rung and the upright 186, and the latter upright up to the nodes $N_{3,2}$ and $N_{3,4}$.

The threads 25 having the indices 3 to 6, 19, 20, 23 and 24 follow the path T2 symmetrical to the path T1 with respect to the sectioning plane of FIG. 35. Starting from the nodes $N_{1,1}$ and $N_{1,3}$ contained in the plane P1 and in the upright 185, those threads successively follow the rung $187_1$, the strut $189_{1,2}$ connecting this rung and the upright 186, and the latter upright up to the nodes $N_{2,2}$ and $N_{2,4}$ contained in the plane P2 and in the upright 186. For travelling from the latter nodes to the nodes $N_{3,1}$ and $N_{3,3}$ contained in the plane P3 and in the upright 185, they follow successively the rung $187_2$, the strut $189_{2,2}$ connecting this rung and the upright 185, and the lat1er upright. And so on. The eight threads of the path T1 cross the eight threads of the path P2 at about the middle of the length of each rung 187. This crossing zone corresponds to three different crossing points ($C_{1,1,2}$, $C_{1,2,3}$ and $C_{1,3,4}$ for instance) of the structure of FIGS. 23 to 27 and 44.

FIG. 36 is a similar view to FIG. 33 but shows how each upright may be made from three parallel thread-like cores respectively 193, 194, 195 and 196, 197, 198. This figure shows in diagrammatic form how flat windings 190 and 203 run diagonally from the cores 193 to 198 and 195 to 196 in addition to flat windings 202 running between corresponding cores in each upright. This gives rise to a step-shaped rung.

FIGS. 37 and 38 relate to a specific shape of ladder that can be manufactured on the lines shown in FIGS. 33 to 35. The structuralmember is then directly useable as a ladder having parallel uprights 211 and 212 with rungs 213 in between to enable a man to climb the ladder. Each rung is supported by two struts 214 and 215 bearing against respective ones of the uprights 211 and 212. The top of the ladder has curved portions 216 and 217 including a rising portion 218 running on from the corresponding upright, a substantially perpendicular portion 219 and a downwardly directed end portion 221, which is substantially parallel to the corresponding upright 211.

The top portion of the ladder may be obtained in the same manufacturing operation as the rest of the ladder, i.e. the uprights and the rungs, by having the drawing device and mandrels follow a corresponding path as shown in FIG. 22. Such a ladder is intended for use by firemen.

Figure 17:
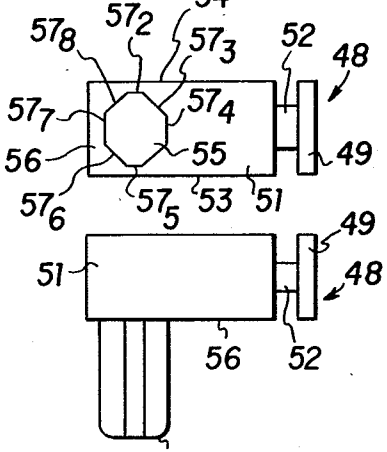
FIG. 17 is a side view of a mandrel support.
Figure 18:
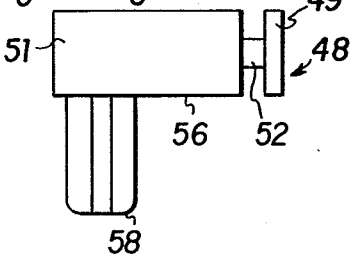
FIG. 18 is a corresponding plan view.

The structural members represented in Figures 32 to 38 and 45 can be obtained by using mandrels of appropriate shape instead of the mandrels with octogonal profile of FIGS. 15 to 17.

It is also possible, for the manufacture of the various types of structural members according to the invention, to replace the mandrels by a mold defining a cavity the shape of which corresponds to a determined length of the structural member, and wherein the cores and the threads are introduced during the braiding of the member.

The use of a mold is particularly advantageous in the case where the uprights, the rungs and the struts if any are formed by cores and threads embedded in a resin, particularly a thermoset such as an epoxide resin.

In particular, each core and each thread can be in the form of a plurality of filaments embedded in a pasty resin, the filaments and the resin filling the cavity of the mold after braiding, i.e. the resin fills the voids inside the cores and/or the threads (between the filaments) and/or between the cores and/or threads forming an upright or a rung. The cured resin retains the shape given by the mold. The curing occurs preferably by application of heat while the embedded cores and threads are inside the mold.

For instance, the mold may consist of modular parts which can be put in place around the uprights and in some cases around the rungs while the manufacture of the structural member is in progress.

Advantageously, after preparing an unitary length by performing a period of the movement of the thread bearing spools, the corresponding mold elements are put in place, the mold elements corresponding to a unitary length previously prepared, on the downstream side of the mold, are removed, and the mold is offset by one unitary length in the downstream direction, i.e. away from the table 1 of the machine, such that the mold in its whole recovers the position it occupied previously. This movement of the mold elements corresponds to the one described for the mandrels of column 46 in relation with FIG. 15.

In the case where the threads extend substantially in straight line from a node to another as shown in FIGS. 43 and 44 for forming a structural member with oblique rungs in accordance with FIGS. 23 to 31, it is not necessary for the cavity of the mold to contain the rungs. Instead, the direction of this can be given by the tension of the threads between the nodes.

I claim:

1. A method of manufacturing an elongated braided structural member having high mechanical strength, including the steps of providing at least three primary elongated cores, parallel and spaced from one another, helically winding a plurality of threads around said cores with at least two threads being wound around any pair of primary cores, providing shaping means and putting the cores and the threads wound around them in contact with said shaping means to shape the member with a predetermined openwork shape, and providing cores and/or threads embedded in a resin and molding the resin for shaping the member.

2. A method according to claim 1, wherein at least two threads are wound along helices of opposite winding directions around each pair of cores.

3. A method according to claim 2, wherein two threads cross each other on one side of the pair of cores and then on the other side, the thread which lies on the inner side of the other thread at one crossing lying on the outer side thereof at the next crossing.

4. A method according to claim 1, wherein at least two threads are wound along helices of the same winding direction around each pair of cores, one of said threads passing on one side of the pair of cores when travelling from a first core of the pair to the other, while the other thread passes on the opposite side of the pair of cores when travelling from said other core to the other core.

5. A method according to claim 4, wherein four threads are wound around each pair of cores, two of which are wound in one winding direction and the other two in the opposite winding direction.

6. A method according to claim 5, wherein twenty-four threads are wound around four primary cores, four threads being wound around each of the six pairs formed by the four cores.

7. A method according to claim 1, including the further steps of providing additional cores between two primary cores and surrounding said additional cores, together with the two primary cores, with the threads wound around the latter.

8. A method according to claim 1, including the step of disposing successive shaping means for successive lengths of the structural member being manufactured which correspond each to the half pitch of winding of the threads.

9. A method according to claim 1, wherein the resin is a thermoset in a pasty state, and including the step of heating said resin during molding for curing it.

10. A method according to claim 1, wherein each core and/or each thread comprises a plurality of parallel filaments.

11. An elongated braided structural member having high mechanical strength, comprising at least three primary elongated cores which are parallel and spaced from one another, and a plurality of threads wound helically around said cores, with each thread being wound helically around a pair of primary cores and each pair of primary cores having at least two threads wound around it, the member having parallel longitudinal uprights containing the cores and rungs extending between the upright and in which at least some of the threads pass.

12. A structural member according to claim 11, wherein the threads meet the primary cores at nodes lying substantially in transverse node planes uniformly distributed along the lengths of the member.

13. A structural member according to claim 12, wherein each of the threads meets alternatively the two corresponding primary cores in successive node planes.

14. A structural member according to claim 11, wherein at least two threads are wound along helices of opposite winding directions around each pair of primary cores.

15. A structural member according to claim 14, wherein two threads cross each other on one side of the pair of cores and then on the other side, the thread which lies on the inner side of the other thread at one crossing lying on the outer side thereof at the next crossing.

16. A structural member according to claim 11, wherein at least two threads are wound along helices of the same winding direction around each pair of cores, one of said threads passing on one side of the pair of cores when travelling from a first core of the pair to the other, while the other thread passes on the opposite side of the pair of cores when travelling from said other core to the other core.

17. A structural member according to claim 16, wherein four threads are wound around each pair of cores, two of which are wound in one winding direction and the other two in the opposite winding direction.

18. A structural member according to claim 17, wherein twenty-four threads are wound around four primary cores, four threads being wound around each of the six pairs formed by the four cores.

19. A structural member according to claim 18, wherein, as viewed in transverse section, the primary cores are disposed at the apexes of a convex quadrilateral, the threads extending along the four sides and the two diagonals of said quadrilateral.

20. A structural member according to claim 19, wherein the quadrilateral is a rectangle.

21. A structural member according to claim 19, wherein the rungs meet the uprights at nodes lying substantially in node planes uniformly distributed along the length of the member.

22. A structural member according to claim 21, wherein the rungs extend obliquely with respect to the length of the member.

23. A structural member according to claim 22, wherein twelve rungs each containing two thread extend between two successive node planes and form six pairs of rungs extending respectively along the four sides and the two diagonals of the quadrilateral, the two rungs of each pair crossing each other in the manner of the letter X.

24. A structural member according to claim 23, comprising four uprights each containing one primary core.

25. A structural member according to claim 23, comprising two uprights each containing two primary cores and at least one additional core disposed intermediate said two primary cores.

26. A structural member according to claim 21, comprising two uprights each containing two primary cores and wherein a rund extends along each node plane, all of the threads wound around one core of one upright and one core of the other uprights passing in said rung.

27. A structural member according to claim 26 having two oblique struts connected to a rung, each of said struts having two ends one of which is joined to the rung and the opposite one is joined to a respective one of the uprights.

28. A structural member according to claim 27, wherein eight threads pass from the first upright to the second upright between a first node plane and a second node plane next to the first one follow successively the rung extending along the first node plane, then the second strut and finally the second upright between said opposite end and the seocnd node plane.

29. A structural member according to claim 11, wherein voids are present inside the cores and the threads and between them in the upright and rungs, and said voids are filled with a resin.

30. A structural member according to claim 11, wherein each core and/or each thread comprises a plurality of parallel filaments.

31. A structural member according to claim 11, wherein additional elongated cores are provides between two primary cores and are surrounded, together with the latter, by the threads wound around time.

32. An elongated braided structural member having high mechanical strength, comprising four primary elongated cores which are parallel, spaced from one another and disposed at the apexes of a convex quadrilateral as viewed in transverse section, and six groups of four thread wound helically respectively around the six pairs of primary cores corresponding to the four sides and the two diagonals of the quadrilateral, two threads of a group being wound in one winding direction and the other two in the opposite winding direction, and one of the two threads which are wound in a same direction around a pair of cores passing on one side thereof when travelling from a first core of the pair to the other, while the other thread passes on the opposite side of the pair of cores when travelling from said other core to said first core, the member having parallel longitudinal uprights containing the cores and rungs extending between the uprights and in which at least some of the threads pass.

* * * * *